US008917488B2

(12) United States Patent
Creager et al.

(10) Patent No.: US 8,917,488 B2
(45) Date of Patent: Dec. 23, 2014

(54) DUST CONTROL FOR ELECTRONIC DEVICES

(71) Applicant: Hewlet-Packard Development Company, L.P., Fort Collins, CO (US)

(72) Inventors: Gregory Doyle Creager, Boise, ID (US); Shaun Henry, Middleton, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 171 days.

(21) Appl. No.: 13/750,654

(22) Filed: Jan. 25, 2013

(65) Prior Publication Data

US 2014/0211364 A1 Jul. 31, 2014

(51) Int. Cl.
*H01T 23/00* (2006.01)

(52) U.S. Cl.
CPC ..... *H01T 23/00* (2013.01)
USPC ..... 361/231

(58) Field of Classification Search
USPC ..... 361/231
See application file for complete search history.

(56) References Cited

U.S. PATENT DOCUMENTS

| | | | | |
|---|---|---|---|---|
| 7,031,134 | B2 | 4/2006 | Izumi et al. | |
| 7,215,526 | B2 * | 5/2007 | Constantinos et al. | 361/231 |
| 8,804,296 | B2 * | 8/2014 | Honer et al. | 361/225 |
| 2008/0006296 | A1 | 1/2008 | Nagata et al. | |
| 2011/0001712 | A1 | 1/2011 | Saito | |
| 2011/0304982 | A1 | 12/2011 | Lin et al. | |

FOREIGN PATENT DOCUMENTS

CN 101650616 2/2010

OTHER PUBLICATIONS

J.W. Arnold et al., Use of Negative Air Ionization for Reducing Bacterial Pathogens and Spores on Stainless Surfaces, 2004, pp. 200-206, vol. 13, Poultry Science Association, Athens, GA.

J.W. Arnold et al., Use of Negative Air Ionization for Reducing Microbial Contamination on Stainless Steel Surfaces, 2007, pp. 179-186, vol. 11, Poultry Science Association, Inc.

R. Sharma et al., Performance Analysis of Electrodynamic Self-cleaning Transparent Films for its Applications to Mars and Lunar Missions, 2007, pp. 434-437.

* cited by examiner

*Primary Examiner* — Stephen W Jackson
(74) *Attorney, Agent, or Firm* — International IP Law Group, PLLC; Nathan E. Stacy

(57) ABSTRACT

An exemplary embodiment includes a method for controlling dust in an electronic device. The method for controlling dust with respect to a computer system, including generating ions proximate to a first region of an electronic device and receiving the ions proximate to a second region of the electronic device, wherein dust particles are captured in the second region.

20 Claims, 6 Drawing Sheets

100

200

300

400

500

600

DUST CONTROL FOR ELECTRONIC DEVICES

BACKGROUND

Electronic devices often collect dust on screens and keyboards from electrostatic charges. Liquid cleaners are sometimes used to clean the screen and disinfect a keyboard. However, using liquids on or near a computer risks damaging the device if liquids seeps into the chassis. Further, the plastic surfaces used for many devices can be damaged by the liquids themselves, depending on the chemicals used. Other manual solutions have been used to clean the screen or disinfect the laptop keyboard for cleaning, including dusters, screen cleaners, and other mechanisms. However, these may not be available or may risk damage to the electronic device.

BRIEF DESCRIPTION OF THE DRAWINGS

Certain examples are described in the following detailed description and in reference to the drawings, in which.

DETAILED DESCRIPTION

Examples described herein provide techniques for using ionized air to move dust particles from a surface of an electronic device to a collection point. The ionized air can also act as an anti-microbial agent to kill bacteria on the surfaces of the electronic device, which may lower the risk of bacterial infection for a user of the electronic device. In an example, an integrated system in a laptop makes use of ionized air to rid the screen of dust and reduce a bacterial load on a computer keyboard. In other examples, the electronic device may be a television, an all-in-one computer, a mobile phone, a tablet computer, a medical device, a public information kiosk, a scientific instrument, a desktop computer, a display, or any number of other electronic devices.

Figure 1:
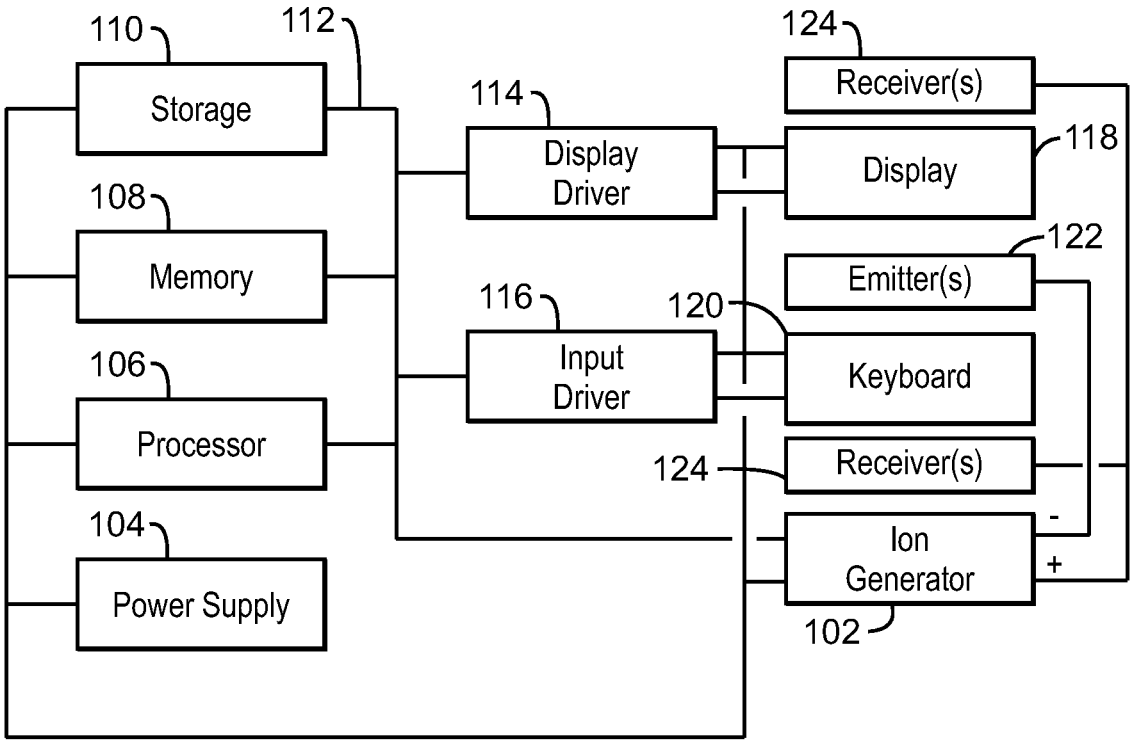
FIG. 1 is a block diagram of an example electronic device that includes an ion generator for dust control.

FIG. 1 is a block diagram of an electronic device 100 that includes an ion generator 102 for dust control. The electronic device 100 has a power supply 104, which may be a battery or a line current power supply. The power supply powers a processor 106, which may be coupled to a memory 108 and/or a storage device 110 through a bus 112. The memory 108 may include any combinations or random access memory (RAM), read only memory (ROM), or programmable read-only memory (PROM), among others. The storage device 110 may include any combinations of hard drives, RAM drives, and the like. The bus 112 may couple the processor 106 to a display driver 114 and an input driver 116. The display driver 114 can power a display 118, while the input driver 116 can decode signals from a keyboard 120 or a mouse, among others. The ion generator 102 may also be coupled to the bus to provide system control of the operational parameters, such as power on/off, voltage, delays, and the like.

The ion generator 102 can generate a high voltage potential, which can be used to generate ions at an ion emitter 122. The ions may flow across the display 118 or the keyboard 120 to one or more receivers 124. Dust particles can be charged by the ions flowing from the ion emitter 122, causing them to move to the ion receiver 124. Once the dust particles are captured on the ion receiver 124, they can be removed, for example, by wiping the ion receiver 124. The electronic device 100 is not limited to the units or configuration shown in FIG. 1. For example, a television may have no large input device, such as a keyboard 120. Accordingly, the ion emitter 122 and ion receiver 124 may be placed so as to only keep one unit clean, such as a display 118.

The ion generator 102 may be manually or automatically activated or disabled. For example, if the electronic device 100 is a laptop computer, the ion generator 102 may be powered when the laptop is opened. After the laptop is closed, the ion generator 102 may be switched off, or may be switched off after a delay time. If the electronic device 100 is a publically accessible display and information unit, the ion generator 102 may be activated when a touch is detected, and left operational for a set period of time after all touches have stopped.

It can be noted that dust problems are not isolated to external area of an electronic device 100. In another example, the ion emitter 122 and ion receiver 124 are located inside an electronic device 100, such as a server, or server drive, among others. In this case, the ion receiver 124 may be configured to be opened or removed for easier cleaning.

Figure 2:
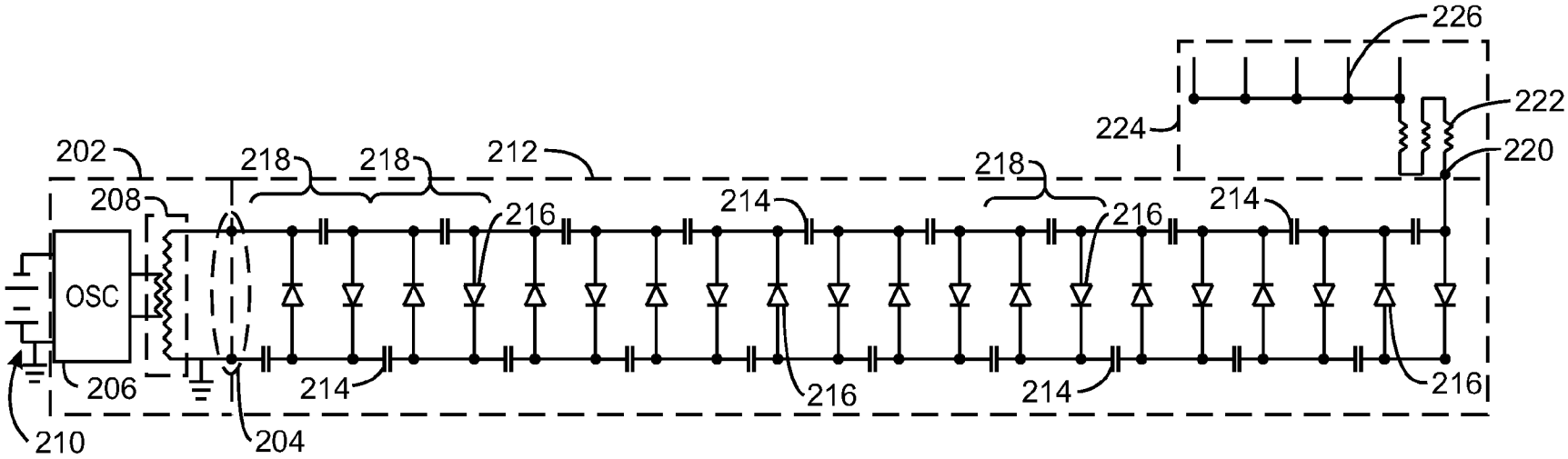
FIG. 2 is a circuit diagram of an example ion generator that may be used in an electronic device.

FIG. 2 is a circuit diagram of an ion generator 200 that may be used in an electronic device. The ion generator 200 may use any number of known circuits to generate the high voltages used to form the ions. In the configuration shown in FIG. 2, a first stage power supply 202 may be used to form an initial feed voltage 204, which may be a square or sine wave AC signal at about 10 volts (v), 50 v, about 100 v, about 150 v, about 250 v, or higher. In this example, the initial feed voltage 204 from the first stage power supply 202 is controlled by the voltage provided by an oscillator circuit 206 and the ratio of input turns to output turns in a driver transformer 208. Although the power for the first stage power supply 202 is shown as a battery 210 in FIG. 2, any number of other circuits can be used to generate the initial feed voltage 204. In an example, a direct power line connection, for example, a 110 volts alternating current (vac), replaces the first stage power supply and provides the initial feed voltage 204. This may be used, for example, for electronic devices that are powered by line voltage.

The initial feed voltage 204 can be provided to a Cockroft-Walton multiplier circuit 212. As is known in the art, the Cockroft-Walton multiplier circuit 212 can be used to generate high voltages, e.g., 5 kilovolts (Kv), 10 Kv, 20 Kv, 50 Kv, or higher. The Cockroft-Walton multiplier circuit 212 uses a string of capacitors 214 and diodes 216 to form a succession of voltage doubling circuits 218. It should be noted that, in order to simplify the diagram, not every circuit component is labeled. Each of the capacitors 214 can be rated for a low capacitance, for example, between about 10 nanofarads (nf) and about 100 nf. The diodes 216 can be any standard type, such as a 1N4007. However, both the capacitors 214 and diodes 216 will generally be rated for high voltages, such as about 1 Kv, 5 Kv, or higher.

In the exemplary circuit shown in FIG. 2, the Cockroft-Walton multiplier circuit 212 has ten stages 218. Thus, a 50 v initial feed voltage 204 will theoretically lead to an output voltage 220 greater than about 50 Kv. However, later stages 218 are not as efficient as earlier stages 218, and, thus, the output voltage 220 for a 50 v initial feed voltage 204 may be 40 Kv, 30 Kv, or less. The current of the outlet voltage 220 is very low, but a series of resistors 220 may be used in the final stage 224 of the ion generator 200 to limit any current to the emitters 226. In FIG. 2, the emitters are pins 226 that may be placed in recesses along a region or surface of the electronic device.

Figure 3:
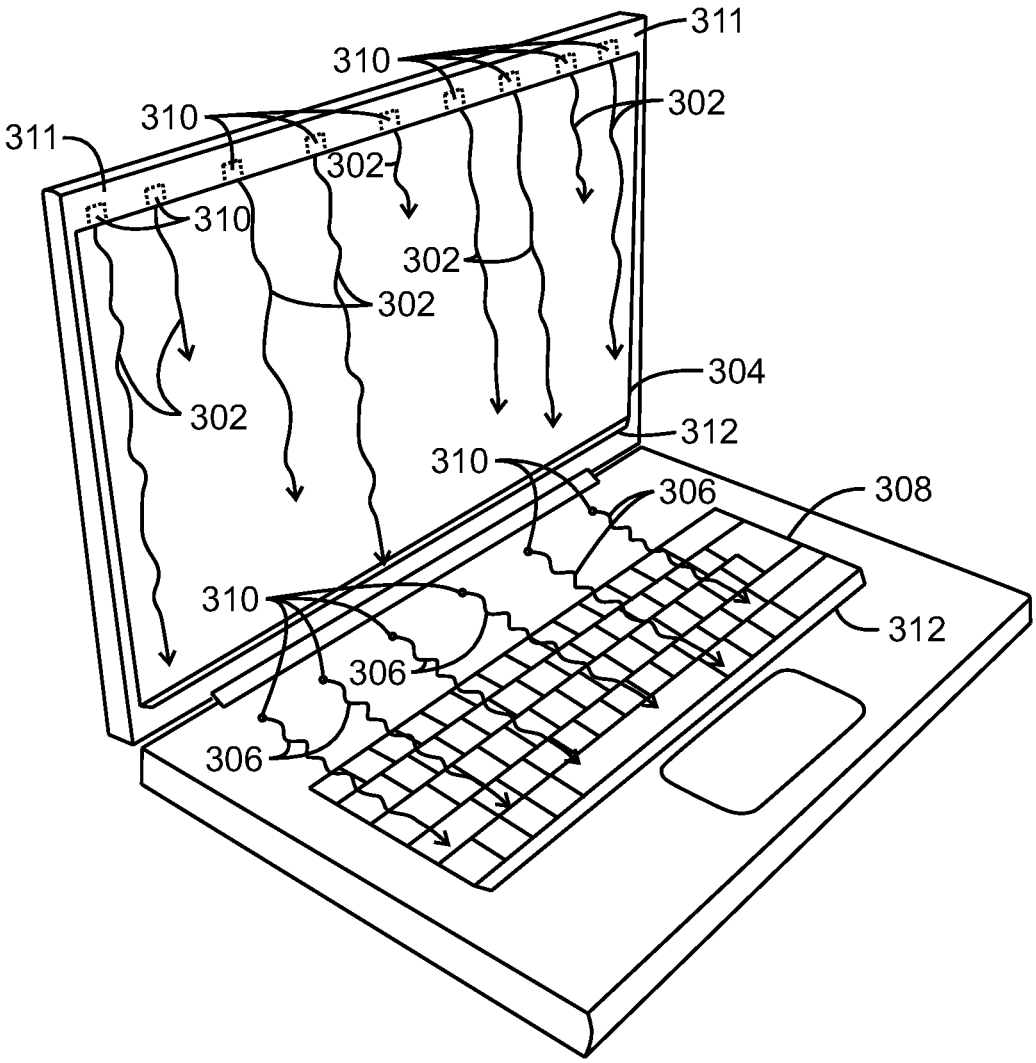
FIG. 3 is a schematic view of an example laptop computer showing the use of generated ions.

FIG. 3 is a schematic view of a laptop computer 300 showing the use of generated ions. A first ion flow 302 may be used to clean a display 304 and a second ion flow 306 may be used to clean a keyboard 308. The laptop computer 300 is not limited to having both ion flows 302 and 306, but may use either by itself. In this example, recessed ion emitters 310 are located along a top edge of the bezel 311 holding the display 304. The recessed ion emitters 310 may be located along an inner edge of the lip of the bezel 311 around the display 304, sending the first ion flow 302 down the front of the display 304. An ion receiver 312 may be placed along the bottom edge of the case holding the display 304. The ion receiver 312 may be a metal plate connected to system ground. The placement of the ion receiver 312 may make cleaning convenient, for example, being just outside the bottom lip of the case holding the display 304. The ion emitters 310 flow ionized air from the top of the display 304, thereby collecting dust in the air stream and directing it the ion receiver 302 and away from the display 304. The ionized air may dissipate over the keyboard 308, thereby picking up dust from the keyboard 308 in addition to killing bacteria on the keyboard 308. According, a separate system for the keyboard 308 may not be chosen.

However, recessed ion emitters 310 may be positioned along the top of the keyboard 308 and an ion receiver 312 may be placed along the bottom of the keyboard 308 to further enhance the effect. In addition to directing dust away from the display 304, the ionized air may also kill bacteria on the keyboard 308 and the other surfaces of the laptop 300 that it comes into contact with. Some studies indicate that about 99.8% of pathogenic bacteria, such as *campylobacter jejuni, escherichia coli, salmonella enteritidis, listeria monocytogenes*, and *staphylococcus aureus*, among others, can be killed by consistent exposure to relatively high levels of negatively ionized air. In each of these examples, the ionized air will naturally flow over the keyboard 308, killing bacteria and thereby reducing the bacterial load on the keyboard and surrounding area. The emitters 310 and receivers 312 are not limited to the configurations shown in FIG. 3, but may be in any number of other configurations, as discussed with respect to FIGS. 4 and 5.

Figure 4:
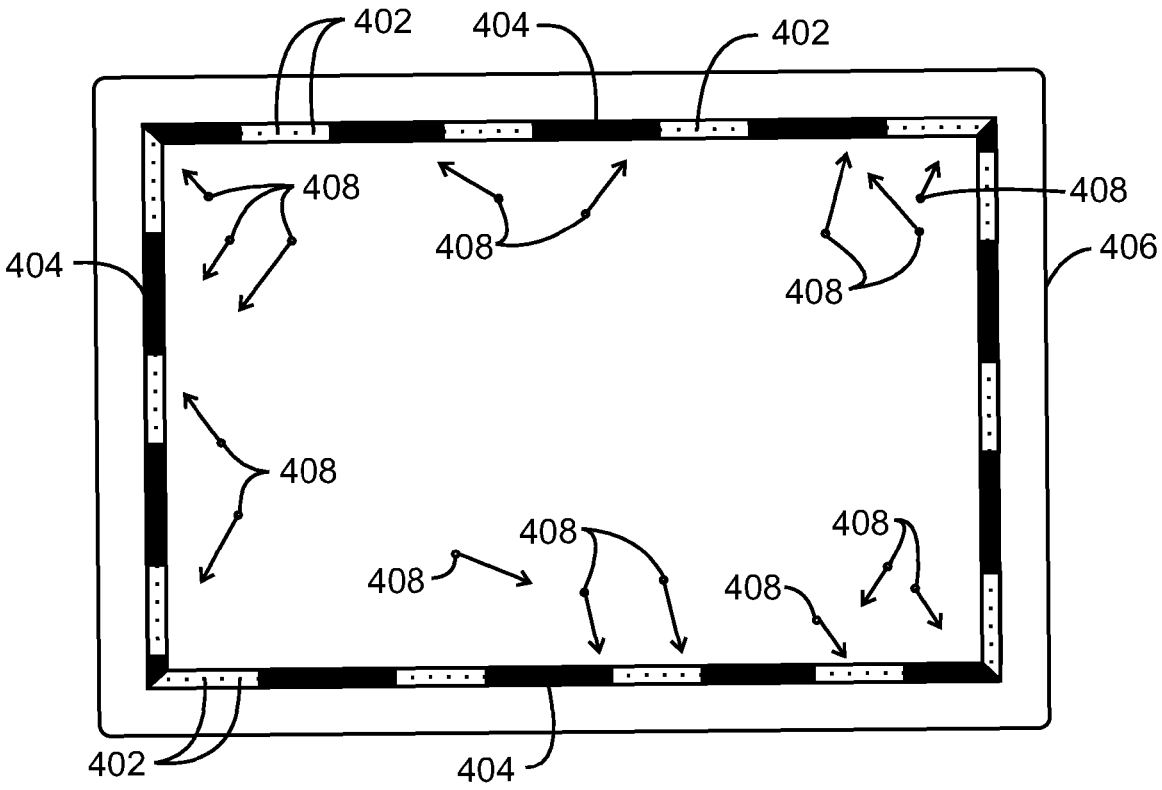
FIG. 4 is a perspective view of an example display having ion emitters and ion receivers placed in an alternating arrangement around a perimeter of a bezel.

FIG. 4 is a front view of a display 400 having ion emitters 402 and ion receivers 404 placed in an alternating arrangement around a perimeter of a bezel 406. In this example, the ion emitters 402 may charge dust particles 408 in the vicinity of the ion emitters 402. The charged dust particles 408 can then be bought to the ion receivers 404 for collection and removal. The ion emitters 402 may be placed in recesses along the interior of the bezel 406, while the ion receivers 404 may be metal plates placed along the interior or exterior of the bezel 406.

As noted herein, if the display 400 is part of a laptop computer, the ion emitters 402 may be left energized for a few minutes after the laptop is closed. This may pull dust from the entrapped space as well as the keyboard, before the unit goes into a sleep mode.

The configuration shown in FIG. 4 may also be useful for larger electronic devices, since the ion emitters 402 and ion receivers 404 can be located in closer proximity to each other than in the configuration shown in FIG. 3. For example, in a large screen television, the top of the bezel 406 may be located about 24 (60 cm), or more, from the bottom of the bezel 406, making ion and dust collection by the ion receiver 404 more problematic if the ion emitters 402 and ion receivers 404 were located at opposite edges.

Figure 5:
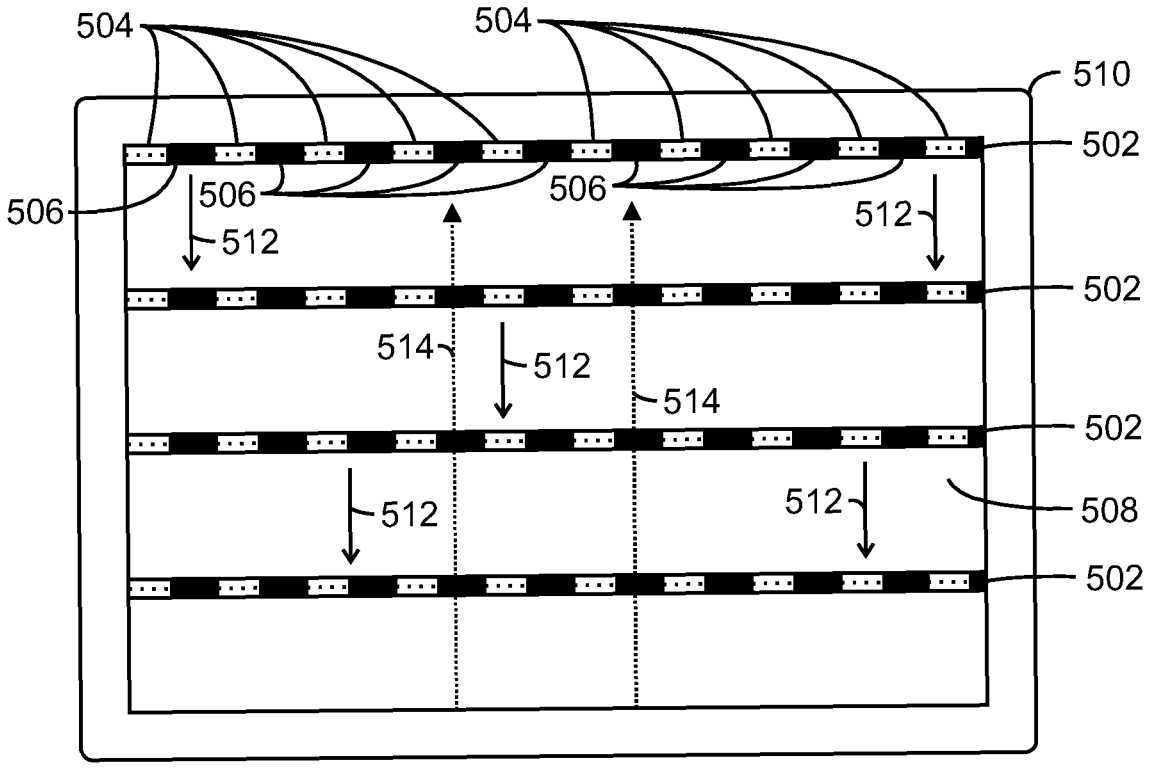
FIG. 5 is a schematic of an example sliding bar that contains both ion emitters and ion receivers moving across a display.

FIG. 5 is a schematic of a sliding bar 502 that contains both ion emitter regions 504 and ion receiver regions 506 moving across a display 508. In this example, the motion of the ion emitters 504 may place them in the vicinity of dust particles, improving the efficiency. The sliding bar 502 may be moved manually, for example, being located in a detachable section of the bezel 510 that slides in a groove in the bezel 510. In other examples, the sliding bar 502 may be configured to slide across the display 508 in a first direction 510 when an electronic device is opened and then return in the opposite direction 514 when the electronic device is closed. In a large device, such as a television, the sliding bar 502 may be moved by a motor, for example, immediately after the television is powered off. In some examples, the sliding bar 504 can emit charges when passing in one direction and collect charged dust particles when returning in the opposite direction.

Figure 6:
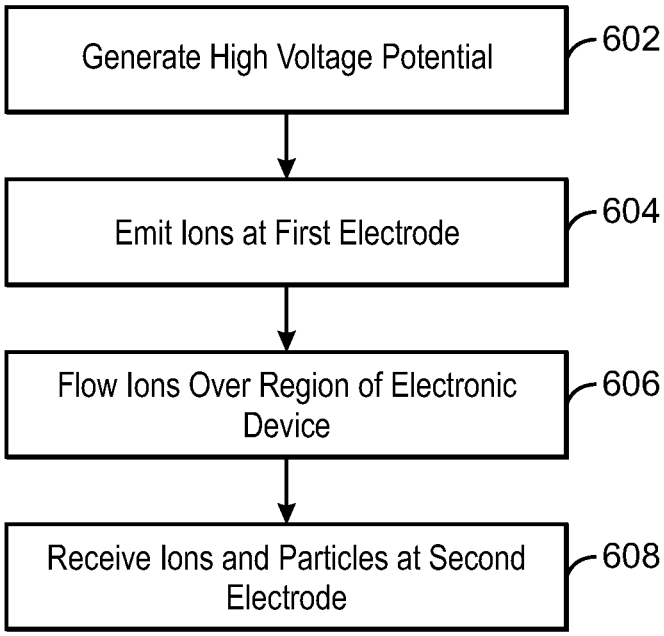
FIG. 6 is an example method for controlling dust in an electronic device.

FIG. 6 is a method 600 for controlling dust in an electronic device. The method begins at block 602 with the generation of a high voltage potential. This may be done using the circuit discussed with respect to FIG. 2, although any number of alternative circuits may be used. At block 604, the high voltage potential is used to generate and emit ions at a first electrode. At block 606, the ions are flowed over a region of the electronic device. As discussed herein, the region can include, for example, a display, a keyboard, or any subsections of these units. At block 608, the ions and any charged particles, such as dust particles, are received at a second electrode. The dust particles can then be wiped off the second electrode.

The use of the charged ion flow may assist with two issues experienced by users of electronic devices, dust buildup, and bacterial contamination. As a result, the techniques described may be useful for devices used in public places and in hospitals, food processing plants, or other areas subject to bacterial contamination. Further, the techniques may be useful for devices placed in public areas, such as airports, restaurants, and the like. Devices that may benefit from the use of the ion generation can include, for example, information kiosks, check-in terminals, touch screen displays, public computer displays, ticket kiosks, or any other electronic devices that are commonly handled by members of the public.

While the present techniques may be susceptible to various modifications and alternative forms, the exemplary embodiments discussed above have been shown only by way of example. It is to be understood that the technique is not intended to be limited to the particular embodiments disclosed herein. Indeed, the present techniques include all alternatives, modifications, and equivalents falling within the true spirit and scope of the appended claims.

What is claimed is:

1. A system for controlling dust with respect to an electronic device, comprising:

an ion generator, including:

a circuit to generate a high voltage direct current (DC) potential;

an ion emitter coupled to a first polarity of the high voltage DC potential; and an ion receiver coupled to a second polarity of the high voltage DC potential, wherein the ion emitter is disposed proximate to a first region of the electronic device and the ion receiver is disposed proximate to a second region of the electronic device, and wherein the first region and second region comprise a display screen.

2. The system of claim 1, wherein the circuit is coupled to a battery in the electronic device.

3. The system of claim 1, wherein the high voltage DC potential is greater than about 10 kilovolts.

4. The system of claim 1, wherein the circuit comprises a Cockcroft-Walton multiplier.

5. The system of claim 1, wherein the ion emitter is coupled to a negative polarity of the high voltage DC potential.

6. The system of claim 1, wherein a plurality of ion emitters is each disposed in a recess along an edge of the electronic device.

7. The system of claim 1, wherein the receiver comprises a single metallic surface disposed along an edge of the electronic device.

8. The system of claim 1, further comprising a plurality of emitters alternating with a plurality of receivers, wherein the plurality of emitters and the plurality of receivers are disposed at a perimeter of a region of the electronic device.

9. The system of claim 1, further comprising a plurality of emitters alternating with a plurality of receivers, wherein the plurality of emitters and the plurality of receivers are disposed along a bar configured to move across a region of an electronic device.

10. The system of claim 1, wherein the electronic device comprises a keyboard.

11. The system of claim 1, wherein the electronic device comprises a laptop computer.

12. The system of claim 1, wherein the electronic device comprises a television.

13. A computing device with an integrated dust control system, comprising:

a high voltage generator;

an ion emitter proximate to a first side of a display of the computing device; and an ion receiver proximate to a second side of the display of the computing device.

14. The computing device of claim 13, further comprising:

a plurality of ion emitters each disposed in a recess along an interior edge of a lip of a case holding the display; and an ion receiver comprising a ground strip located along an edge of the lip of the case holding the display opposite the plurality of ion emitters.

15. The computing device of claim 13, comprising:

a plurality of ion emitters each disposed in a recess along an interior edge of a lip of a case holding a keyboard; and an ion receiver comprising a ground strip located along an edge of the lip of the case holding the keyboard opposite the plurality of ion emitters.

16. A system comprising:

a recessed ion emitter disposed proximate to a first region of an electronic device; and an ion receiver disposed proximate to a second region of the electronic device, wherein the recessed ion emitter is to generate a high voltage direct current (DC) potential to flow ionized air from the recessed ion emitter to the ion receiver.

17. The system of claim 16, wherein the recessed ion emitter is to generate a high voltage DC potential to flow ionized air to move dust particles to the second region of the electronic device.

18. The system of claim 16, wherein the recessed ion emitter is to generate a high voltage DC potential to expose the electronic device to high enough levels of negatively ionized air to reduce a bacterial load on the electronic device.

19. The system of claim 16, comprising:

a plurality of recessed ion emitters disposed proximate to a first region of an electronic device, wherein the plurality of recessed ion emitters are to generate a high voltage DC potential to flow ionized air from the recessed ion emitters to the ion receiver.

20. The system of claim 16, wherein the electronic display is a touch screen display.

* * * * *

UNITED STATES PATENT AND TRADEMARK OFFICE

CERTIFICATE OF CORRECTION

PATENT NO. : 8,917,488 B2
APPLICATION NO. : 13/750654
DATED : December 23, 2014
INVENTOR(S) : Gregory Doyle Creager et al.

It is certified that error appears in the above-identified patent and that said Letters Patent is hereby corrected as shown below:

Title Page (71), Applicant, in column 1, line 1, delete "Hewlet-Packard" and insert -- Hewlett-Packard --, therefor.

Signed and Sealed this
Twenty-eighth Day of April, 2015

Michelle K. Lee

Michelle K. Lee
*Director of the United States Patent and Trademark Office*